US006073571A

United States Patent [19]

Whitener

[11] Patent Number: 6,073,571

[45] **Date of Patent: *Jun. 13, 2000**

[54] MOORING AND RAMP SYSTEM FOR FERRY BOATS

[76] Inventor: Philip C. Whitener, 5955 Battle Point Dr., Bainbridge Island, Wash. 98110

[ * ] Notice: This patent is subject to a terminal disclaimer.

[21] Appl. No.: 08/821,807

[22] Filed: Mar. 21, 1997

Related U.S. Application Data

[63] Continuation-in-part of application No. 08/528,615, Sep. 15, 1995, Pat. No. 5,623,889.

[51] Int. Cl.[7] ..... B63B 21/00

[52] U.S. Cl. ..... 114/230.1

[58] Field of Search ..... 114/230, 231, 114/258, 72, 230.1, 230.15

[56] References Cited

U.S. PATENT DOCUMENTS

| | | | |
|---|---|---|---|
| 768,765 | 8/1904 | Maclean . | |
| 1,799,456 | 4/1931 | Cavert . | |
| 1,913,207 | 6/1933 | McDougall . | |
| 2,117,121 | 5/1938 | Urquhart et al. | 114/219 |
| 2,389,353 | 11/1945 | Foss . | |
| 2,672,840 | 3/1954 | Sharp et al. . | |
| 3,069,862 | 12/1962 | Ward . | |
| 3,320,918 | 5/1967 | Zalejski . | |
| 3,326,171 | 6/1967 | Zade . | |
| 4,008,675 | 2/1977 | Johansson . | |
| 4,766,829 | 8/1988 | Schlichthorst . | |
| 5,415,120 | 5/1995 | Burg . | |
| 5,623,889 | 4/1997 | Whitener . | |

FOREIGN PATENT DOCUMENTS

| | | |
|---|---|---|
| 3712534 | 4/1987 | Germany . |
| 60-163788 | 8/1985 | Japan . |
| 258048 | 11/1969 | Russian Federation . |
| 532548 | 10/1976 | Russian Federation . |
| 895341 | 5/1958 | United Kingdom . |
| WO 90/05660 | 5/1990 | WIPO . |

*Primary Examiner*—Ed Swinehart

*Attorney, Agent, or Firm*—Christensen O'Connor Johnson & Kindness PLLC

[57] ABSTRACT

The subject system includes a ramp subsystem and a mooring subsystem and is intended for use with single and multi deck ferry boats with ramp service directly to each deck. The ramp subsystem is carried on a float which is connected to the shore by a ramp hinged to the shore and to the float. A second ramp is hinged on the float and is adjustable to serve each deck of a multi deck boat in sequence. In an alternate embodiment, there are as many decks on the float as there are decks on the boats and no adjustment is needed. The mooring subsystem involves mechanism which connects an end of the boat to the float and allows lateral translation of the boat relative to the float, enabling the boat to be moored at one location on the float for unloading and to be moved to a second location for loading. This allows for one boat to be loading while a second is unloading simultaneously. There is a mooring mechanism at each side of the end of the boat and each mechanism includes at least one roller at a fixed center which engages one face of the rail and at least one roller controllable to engage and disengage the opposite face of the rail.

17 Claims, 2 Drawing Sheets

MOORING AND RAMP SYSTEM FOR FERRY BOATS

CONTINUATION-IN-PART

This application is a continuation-in-part application of U.S. patent application Ser. No. 08/528,615, filed Sep. 15, 1995.

FIELD OF THE INVENTION

The subject invention is in the fields of equipment and apparatus used for mooring boats and ships and of facilities used for loading and unloading what is carried by the vessels, i.e. the payloads, in particular vehicles and passengers. More particularly, it is in these fields as applicable to ferry boats for which it is especially important that mooring, loading and unloading be done expeditiously.

BACKGROUND OF THE INVENTION

With the conventional prior art in these fields, as applied to ferry boats, the boats come into the dock end first guided by pilings or wingwalls, are held in place by mooring lines and/or vessel propulsion, and a ramp hinged on the dock facility is lowered to the main deck of the boat for unloading payload and then raised before the boat departs. The ramps are usually no more than two vehicle lanes wide while the decks of the boats are often several lanes wide. This situation sets up requirements that the boat be fitted with inter-deck ramps and that deck space be devoted specifically to provision for convergence of the several lanes to the one or two used for loading and unloading. Meeting these requirements limits the number of decks which can be feasibly used and lowers the ratio of payload space to total deck space of the boats using such mooring and ramp systems, thus limiting the traffic flow rate capability of the ferry system, especially relative to the speeds and displacements of the boats used in the system. A second aspect of conventional mooring and ramp systems which limits the traffic flow rate capability is that each boat must be unloaded and loaded in sequence, requiring significantly more time per turn around than would be required if loading and unloading were done simultaneously.

U.S. Pat. No. 3,069,862 issued to Ward discloses a floating transfer bridge having a shore end that is pivotably secured for movement in a vertical plane and a seaward end supported by a float which raises and lowers the seaward end of the bridge section as the tides change the water level. Thus, the pivotable movement of the seaward end allows more than one lane of a ferry boat to be aligned therewith. Ward discloses a floating transfer bridge that is, itself, pivotable, and does not disclose a mooring and ramp system which allows a moored boat to be moved laterally relative to the mooring and ramp system.

U.S. Pat. No. 1,913,207 issued to McDougall discloses a boat for transporting vehicles having a plurality of decks and a dock having two sets of tracks, one above the other, for conveying vehicles to and from the vessel. A doubledeck ramp is hingedly attached to the fixed termini of the tracks, with the free end of the ramp registerable with the decks of the vessel. Again, McDougall does not disclose a mooring and ramp system in which the boat, when secured to the mooring and ramp system, is movable laterally relative thereto.

U.S. Pat. No. 3,320,918 issued to Zalejski discloses a combination of a floating dock and a plurality of motorized barges. The floating dock can be moored away from shore and the barges moved between the dock and the shore. Each of the barges can support a quantity of vehicles thereon. Each of the decks provides a space for parking the vehicles.

U.S. Pat. No. 3,326,171 issued to Zade discloses a device for minimizing damages arising from ship collisions which includes a rotatable abutment member mounted on a ship's hull which functions, during the initial contact between a ship and a striking ship, to swerve the bow of the striking ship laterally whereby head-on impact is avoided.

U.S. Pat. No. 2,389,353 issued to Foss discloses a floating dock that is held in position by chains connected to pilings sunk wholly beneath the surface of the ground where it is protected from borers and is not subjected to unsupported strains exerted against the piling transversely thereof. The floating dock is configured to cushion the landing of a boat, thus minimizing damage to the boat and the dock.

U.S. Pat. No. 768,765 issued to Maclean for a device for securing vessels to moorings includes electromagnets located on the boat or a landing and collective armature disposed on the other of the boat and the landing. In this manner, the boat is magnetically secured to the landing.

Russian Patent Publication No. 258048 discloses a ship docking device that is employed where the length of the ship exceeds that of the dock. A directing track has a closed circuit. The directing track may be in channel form with the centering cables connected to shock absorbers. When a ship is brought into or taken out of the dock, each trolley is connected by cables with shock absorbers to the hull of the ship. Capstans are then used to move an endless chain with trolleys along the closed track. Other capstans are used to operate a chain which speeds up their motion as they move along the dock by interaction with teeth of the trolleys.

Accordingly, a need exists for the enhancement of the traffic flow rate capability of a ferry system. Further needs exist for: (1) a mooring and ramp system unaffected by changes in water level caused by tides or other factors, (2) a mooring and ramp system that facilitates simultaneous loading and unloading of boats, and (3) a mooring and ramp system that facilitates use of multi-deck ferry boats.

SUMMARY OF THE INVENTION

The subject invention is a mooring and ramp system for ferry boats, particularly those having a plurality of decks with each deck comprising a plurality of straight lanes. In one embodiment of the subject system a hinged ramp serves the full width of each deck in sequence. In other embodiments two or more independent ramps may be used. The ramp facility is mounted on a float so that its operating level suits that of the ferry boats regardless of changes in water level caused by tides. The float is connected by a ramp to the shore based portion of the system, the ramp being hinged at both ends. Also, the mooring is done mechanically using powered mechanism which can accommodate and/or cause lateral movement of the moored boat along with vectored thrust and state of the art instrumentation to enable bringing the boat in without external assistance. In this system, once a boat is unloaded it is moved laterally to a position in which it is loaded while another boat moves into the unloading position. Thus loading and unloading occur essentially simultaneously. The mechanical mooring assures precise relative positioning of the ramp and decks, and also allows lateral movement of the boat for ramp alignment after the boat is moored, thus reducing the precision required in docking the boat.

The mooring mechanism comprises heavy duty tired wheels or rollers, some of which are powered to cause the lateral movement. Some of the wheels/rollers are on fixed axles, some are mechanically adjusted to effect engagement and disengagement of the boat and mooring facility. The wheels/rollers may all be mounted on and powered from either the mooring facility or the boat or may be divided between the two. Alternately, the wheels/rollers may be used for engagement and guidance only with the power being provided by a conveyor chain or the like.

In an alternate embodiment of the subject invention the ends of the boat for example, linear or arc shaped, lateral motion of an end turns the boat about its vertical center and the docking configuration allows loading from one end of the boat while unloading from the other end. In this embodiment a plurality of vertically arrayed ramps on the float are alignable with vertically arrayed decks on the boat.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
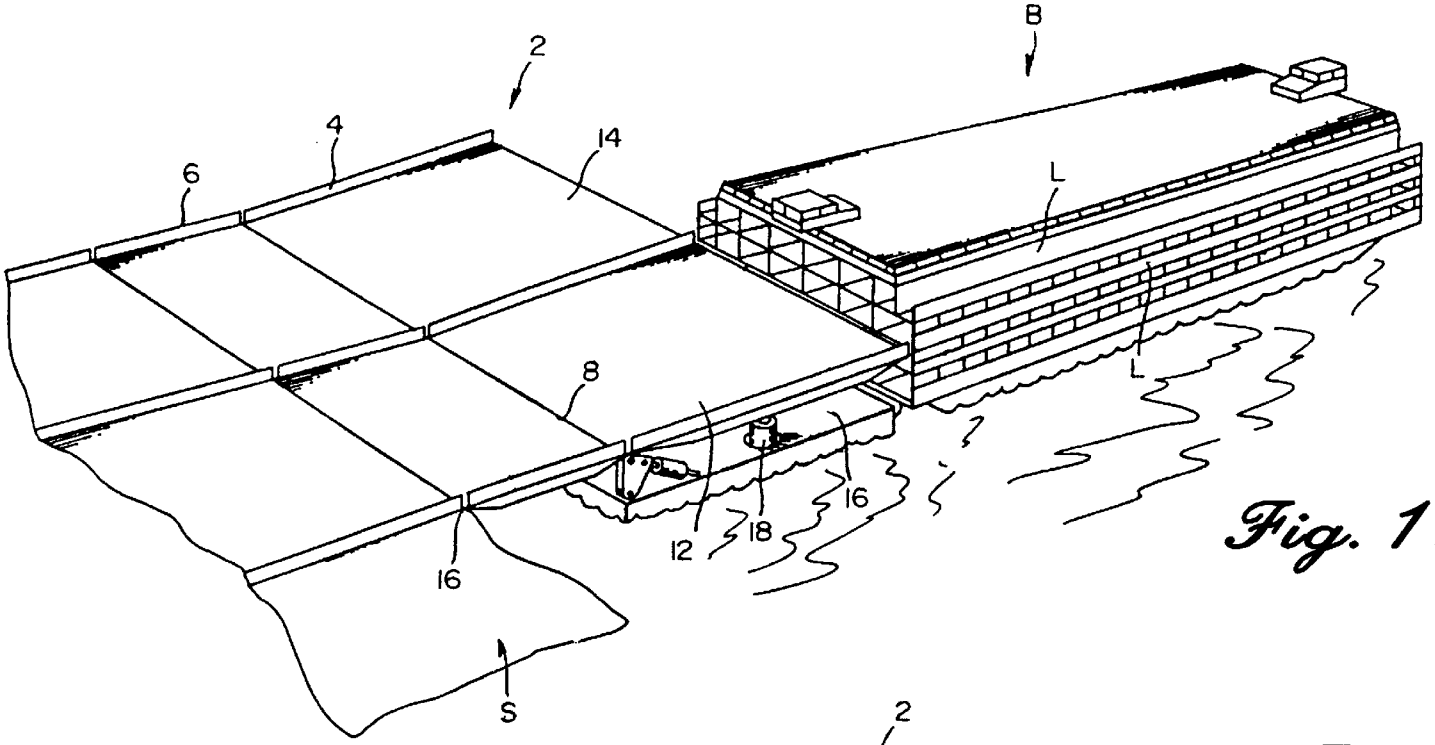
FIG. 1 is a general, semi-schematic view of a ferry boat, configured to suit the subject system, moored to the subject system.
Figure 2:
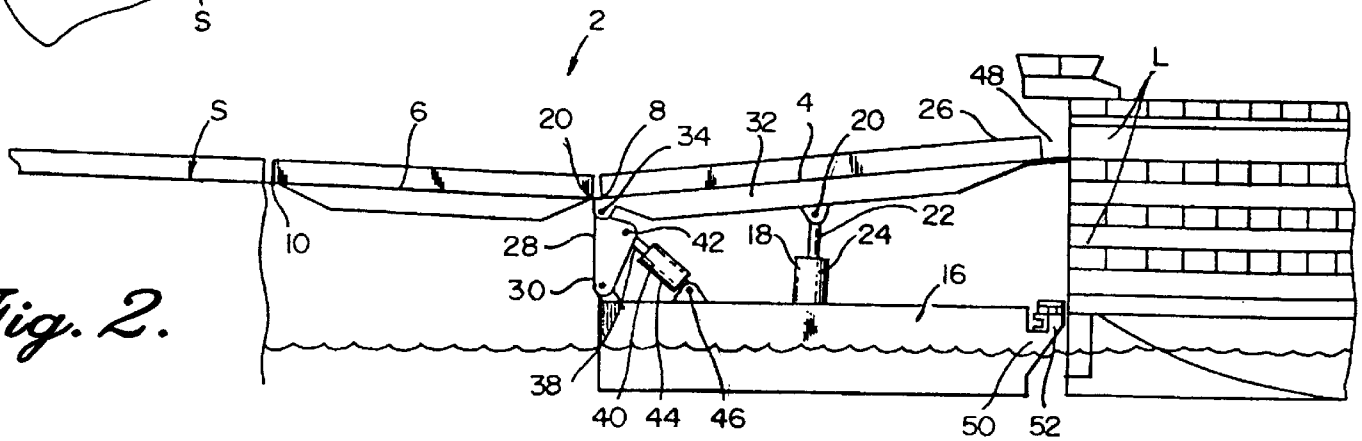
FIG. 2 is a schematic end view of the ramp subsystem.

As shown in FIGS. 1 and 2, mooring and ramp system 2 allows transport of vehicles, passengers, and/or cargo from boat B to shore S. While boat B is shown as a multi-deck ferry boat, it is understood that boat B can be any type of aquatic vehicle. Mooring and ramp system 2 includes seaward ramp portion 4 hingedly secured to shoreward ramp portion 6 by hinges 8 such that vertical pivotal motion between seaward ramp portion 4 and shoreward ramp portion 6 is possible. Shoreward ramp portion 6 is pivotally secured to shore S by hinges 10 such that shoreward ramp portion 6 is vertically pivotal with respect to shore S. Hinges 8 and hinges 10 thus accommodate changes in the relative positioning of seaward ramp portion 4 and shoreward ramp portion 6 by tides and currents. Preferably, seaward ramp portion 4 and shoreward ramp portion 6 each have at least two lanes 12 and 14 that are substantially parallel with respect to one another. As will be described in more detail below, boat B can thus be unloaded from lane 12 and subsequently moved laterally to lane 14 to be reloaded with the mooring and ramp system 2 of the subject invention.

Seaward ramp portion 4 is preferably supported by float 16 which has sufficient water buoyancy to keep seaward ramp portion 4 afloat. Seaward ramp portion 4 is secured to float 16 by actuator 18, which is preferably a hydraulic piston known in the art. Actuator 18 is attached to float 16 and is secured to seaward ramp portion 4 by flange 20. Actuator 18 includes rod 22, the extension of which, with respect to cylinder 24 of actuator 18, causes seaward ramp portion 4 to be elevated vertically with respect to float 16, and retraction of rod 22 with respect to cylinder 24 of actuator 18 causes seaward ramp portion 4 to be lowered vertically with respect to float 16, as seaward ramp portion 4 pivots around hinge 8. The aforesaid change in vertical orientation of seaward ramp portion 4 allows outboard end 26 of seaward ramp portion 4 to individually access a plurality of levels L on boat B for loading and unloading of boat B.

Seaward ramp portion 4 is preferably also secured to float 16 by actuator bracket 28. Actuator bracket 28 is preferably substantially triangular in cross-section and is pivotably secured to float 16 at lower apex 30, is pivotally secured to extension member 32 at upper apex 34 and is secured to rod 38 of actuator 40 at side apex 42. Actuator 40 is preferably a hydraulic actuator known in the art and, in addition to rod 38, includes cylinder 44. Actuator 40 is preferably secured to float 16 at flange 46. Extension member 32 is preferably a planar member located under seaward ramp portion 4 terminating in lip 48 proximal to outboard end 26 of seaward ramp portion 4. Thus, upon retraction of rod 38 relative to cylinder 44 of actuator 40, actuator bracket 28 pivots around lower apex 30 toward outboard end 26 of seaward ramp portion 4 causing extension member 32 to extend lip 48 to bridge any gap between outboard end 26 of seaward ramp portion 4 and a level L of boat B. Extension of rod 38 with respect to cylinder 44 of actuator 40 causes actuator bracket 28 to pivot around lower apex 30 toward shore ramp portion 6 to retract extension member 32 and associated lip 48 from a level L of boat B.

Figure 3:
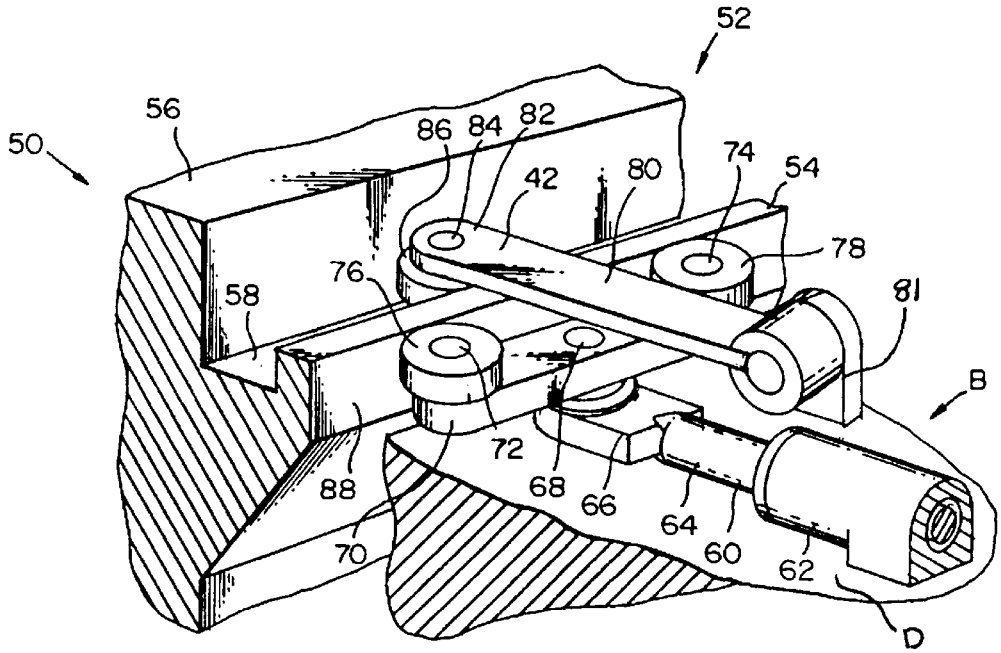
FIG. 3 is a schematic view of one embodiment of a mechanized mooring subsystem.

Now referring to FIGS. 2 and 3, boat B is preferably moored to outboard end 50 of float 16 by mooring apparatus 52. More specifically referring to FIG. 3, outboard end 50 of float 16 includes rail 54 spaced from baseboard 56 by channel 58. Rail 54, baseboard 56 and channel 58 preferably span the width of float 16. Located at one or more locations on deck D of boat B is mooring base 60 which is preferably a hydraulic mechanism having a cylinder 62 attached to deck D of boat B and a rod 64. Thus, mooring and docking forces between float 16 and boat B encountered by rod 64 are absorbed in cylinder 62 of mooring base 60. Rod 64 has an exterior end 66 having pivot pin 68 thereon which horizontally pivotally attaches roller bar 70 to rod 64. Roller pins 72 and 74 on the exterior ends of roller bar 70 rotatably support rollers 76 and 78, respectively. Roller arm 80 is vertically pivotally connected to deck D of boat B at vertically projecting support 81, and has an exterior end 82 with roller pin 84 thereon that rotatably supports roller 86. In operation, as deck D of boat B approaches outboard end 50 of float 16, rollers 76 and 78 on roller bar 70 contact outer face 88 of rail 54; any mooring and docking forces associated with this contact are transferred from roller bar 70 to rod 64 and into cylinder 62 of mooring base 60. Upon stable contact between rollers 76 and 78 with outer face 88 of rail 54, roller arm 80 is pivoted downwardly into channel 58 such that roller 86 contacts inner face 90 of rail 54, bracing rail 54 between roller 86 and rollers 76 and 78. Rollers 76 and 78 are then rotated by, for example, hydraulic power, such that rollers 76 and 78 travel along outer face 88 of rail 54 and roller 86 travels along inner face 90 of rail 54 to cause lateral movement of boat B with respect to float 16 and mooring and ramp system 2 as a whole. For example, boat B is movable laterally from lane 12 after unloading of vehicles, passengers and/or cargo to lane 14 for loading of vehicles, passengers and/or cargo while a second boat B can simultaneously occupy now free lane 12 of seaward ramp portion 4. Alternatively, rollers 76 and 78 are not powered and lateral movement of boat B relative to seaward ramp portion 4 is affected by chains on mooring and ramp system 2 that are disengagably engaged by hooks or palls on boat B.

Figure 4:
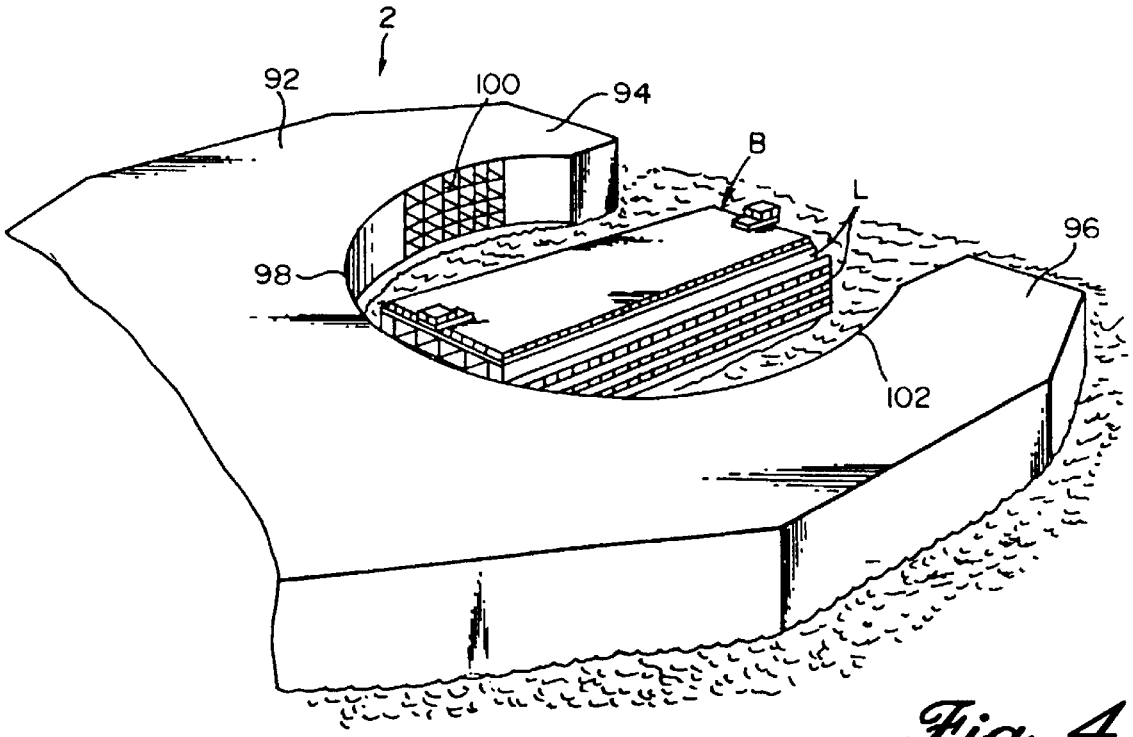
FIG. 4 is a general view of an alternate dock configuration employing the subject mooring subsystem.

FIG. 4 illustrates an alternate configuration of mooring and ramp system 2, wherein dock 92 is a floating facility having two arms 94 and 96 enclosing and joined by an arcuate mooring contour 98. In this configuration, boat B enters the area between arms 94 and 96 and moors in arcuate mooring contour 98 of dock 92 between arms 94 and 96. The moored end of boat B is then translated around mooring contour 98 by mooring apparatus 52, as described above, such that boat B rotates about 90 degrees whereby one end of boat B moors to decks 100 of arm 94 and the other end of boat B moors with decks 102 of arm 96. Note that decks 100 and 102 are a plurality of vertically arrayed decks which are configured to align with the multiple levels L of boat B such that vertical movement of a single ramp, as in the first embodiment of the present invention, is not required to load and unload a plurality of levels L of boat B. In the present embodiment of FIG. 4, once boat B is fully moored, vehicles, pedestrian and/or cargo can disembark from the end of boat B moored to decks 100 of arm 94 and different vehicles, passengers and/or cargo can be loaded through decks 102 of arm 96. Once loading and unloading is complete, boat B is rotated 90 degrees again to leave dock 92.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A mooring and ramp system comprising:

an aquatic vehicle having at least one transport deck;

a ramp system for providing access to and from the transport deck, the ramp system including at least one ramp and a float for supporting the at least one ramp;

a mooring apparatus detachably attaching the aquatic vehicle with the ramp system; the mooring apparatus including a rail connected to the ramp system and at least one roller connected to the aquatic vehicle, the at least one roller being engagable with the rail to allow translation of the aquatic vehicle relative to the ramp system; and means for moving the aquatic vehicle relative to the ramp system.

2. The system of claim 1, wherein the transport deck and the ramp system each have a number of vehicle lanes; and wherein the means for moving the aquatic vehicle is used to align the transport deck vehicle lanes with the ramp system vehicle lanes.

3. The system of claim 1, wherein the ramp system includes a first ramp used to allow vehicles to exit the aquatic vehicle and a second ramp used to allow vehicles to enter the aquatic vehicle.

4. The system of claim 3, wherein the first and second ramps are positioned adjacent to one another; during use, the mooring apparatus connects the aquatic vehicle to the first ramp to unload objects after which the means for moving the aquatic vehicle moves the aquatic vehicle to the second ramp to load objects.

5. The system of claim 1, wherein the aquatic vehicle includes a plurality of vertically-arrayed transport decks; and the at least one ramp is vertically movable to access the plurality of decks.

6. The system of claim 1, wherein the ramp system includes a shoreward ramp portion having a first end pivotally attachable to shore and a second end opposite the first end; and a seaward ramp portion pivotally connected at one end to the shoreward ramp portion second end to allow vertical access to the plurality of vertically-arrayed transport decks.

7. The system of claim 6, wherein a first actuator is used to raise and lower the seaward ramp portion, the first actuator being positioned between an upper surface of the float and an undersurface of the loading ramp.

8. The system of claim 7, wherein the pivotal connection of the seaward ramp with the shoreward ramp includes a hinge, a bracket rotatably interconnected between the upper surface of the float and the hinge, and a second actuator interconnected between the float and the bracket, whereby extension and retraction of the second actuator causes the hinge to move relative to the float thereby providing for minor adjustment of the seaward ramp in meeting the transport decks.

9. The system of claim 1, wherein the aquatic vehicle includes a plurality of vertically-arrayed transport decks and the ramp system includes a plurality of ramps supported by the float and alignable with the plurality of vertically-arrayed transport decks.

10. The system of claim 9, wherein the ramp system is formed in a concave arcuate mooring contour.

11. The system of claim 9, wherein the ramp system includes two sets of vertically-arrayed ramps, the mooring apparatus extending between the two sets of ramps such that the means for moving the aquatic vehicle can move the vehicle therebetween.

12. The system of claim 11, wherein the ramp system includes a pair of outwardly extending arms that form a concave arcuate mooring contour, the two sets of vertically-arrayed ramps being positioned opposite one another on each arm.

13. The system of claim 12, wherein the aquatic vehicle includes first and second opposite ends, each end having access to at least one transport deck; and wherein the two sets of vertically-arrayed ramps are positioned along the arcuate mooring contour such that one set of vertically-arrayed stationary ramps allows access to the boat first end and the other set of vertically-arrayed stationary ramps allows access to the boat second end.

14. The system of claim 1, wherein the rail is attached to the float and spans its width.

15. The system of claim 1, wherein the rail is upright and has an inner surface and an outer surface, the at least one roller includes a first roller that rotates about an upright axis and that engages the rail inner surface and second and third rollers that each rotate about an upright axis and engage the rail outer surface; during use, the rail is sandwiched between the first roller and the second and third rollers, thereby allowing the mooring apparatus to effectively engage the ramp system with the aquatic vehicle.

16. The system of claim 1, wherein the means for moving the aquatic vehicle includes motorized means to power the rollers.

17. The system of claim 1, wherein the mooring apparatus further includes a shock absorber between the ramp system and the aquatic vehicle for absorbing forces associated with boat mooring.

* * * * *